US007914666B1

(12) United States Patent
Mehlberg et al.

(10) Patent No.: US 7,914,666 B1
(45) Date of Patent: Mar. 29, 2011

(54) LOW $NO_x$ FCC CATALYST REGENERATION PROCESS

(75) Inventors: Robert Mehlberg, Wheaton, IL (US); Frank Rosser, Jr., LaGrange Park, IL (US); Zhihao Fei, Naperville, IL (US); Carl Stevens, Lake Forest, IL (US)

(73) Assignee: UOP LLC, Des Plaines, IL (US)

( * ) Notice: Subject to any disclaimer, the term of this patent is extended or adjusted under 35 U.S.C. 154(b) by 569 days.

(21) Appl. No.: 11/540,175

(22) Filed: Sep. 29, 2006

(51) Int. Cl.
*C10G 11/18* (2006.01)

(52) U.S. Cl. ..... 208/113

(58) Field of Classification Search ..... 208/46, 208/106, 113–124
See application file for complete search history.

(56) References Cited

U.S. PATENT DOCUMENTS 3,245,920 A * 4/1966 Keith et al. ..... 502/334
4,778,665 A * 10/1988 Krishnamurthy et al. .... 208/113
4,784,752 A * 11/1988 Ramamoorthy et al. ..... 208/113
4,812,430 A * 3/1989 Child ..... 208/113
4,851,374 A * 7/1989 Yan et al. ..... 208/113
4,986,897 A * 1/1991 Chin ..... 208/113

* cited by examiner

*Primary Examiner* — Glenn Caldarola
*Assistant Examiner* — Randy Boyer
(74) *Attorney, Agent, or Firm* — James C Paschall

(57) ABSTRACT

An FCC process producing lower NOx emissions during regeneration by using excess oxygen levels at less than or equal to about 0.5 mol-% and a plenum temperature above about 730° C. (about 1350° F.). The process may further include limiting the Pt content in the catalyst to less than or equal to about 0.5 ppm. $NO_x$ emissions, NO to $NO_2$, produced through this process may be equal to or less than 25 ppmv. The process may also include adjusting the metal content of the feedstock for such metals as antimony, nickel, or vanadium. Additional variables for reducing $NO_x$ emissions that may be used in conjunction with this process may include increasing the flue gas residence time, injecting $NH_3$ into the flue gas, adding or using $NO_x$-reducing catalysts, increasing stripping of the catalyst, and increasing the catalyst zeolite to matrix ratio.

13 Claims, 2 Drawing Sheets

LOW $NO_x$ FCC CATALYST REGENERATION PROCESS

BACKGROUND OF THE INVENTION

This invention relates generally to a process for catalytic cracking of hydrocarbons.

DESCRIPTION OF THE PRIOR ART

Fluid catalytic cracking (FCC) is a catalytic conversion process for cracking heavy hydrocarbons into lighter hydrocarbons by bringing the heavy hydrocarbons into contact with a catalyst composed of finely divided particulate material. Most FCC units use zeolite-containing catalyst having high activity and selectivity.

The basic components of the FCC process include a riser, a reactor vessel, a catalyst stripper, and a regenerator. In the riser, a feed distributor inputs the hydrocarbon feed which contacts the catalyst and is cracked into a product stream containing lighter hydrocarbons. Catalyst and hydrocarbon feed are transported upwardly in the riser by the expansion of the lift gases that result from the vaporization of the hydrocarbons, and other fluidizing mediums, upon contact with the hot catalyst. Steam or an inert gas may be used to accelerate catalyst in a first section of the riser prior to or during introduction of the feed. Coke accumulates on the catalyst particles as a result of the cracking reaction and the catalyst is then referred to as "spent catalyst." The reactor vessel disengages spent catalyst from product vapors. The catalyst stripper removes absorbed hydrocarbon from the surface of the catalyst. The regenerator removes the coke from the catalyst and recycles the regenerated catalyst into the riser.

The spent catalyst particles are regenerated before catalytically cracking more hydrocarbons. Regeneration occurs by oxidation of the carbonaceous deposits to carbon oxides and water. The spent catalyst is introduced into a fluidized bed at the base of the regenerator, and oxygen-containing combustion air is passed upwardly through the bed. After regeneration, the regenerated catalyst is returned to the riser.

Oxides of nitrogen ($NO_x$) are usually present in regenerator flue gases but should be minimized because of environmental concerns. Regulated $NO_x$ emissions generally include nitric oxide (NO) and nitrogen dioxide ($NO_2$), but the FCC process can also produce $N_2O$. In an FCC regenerator, $NO_x$ is produced almost entirely by oxidation of nitrogen compounds originating in the FCC feedstock and accumulating in the coked catalyst. At FCC regenerator operating conditions, there is negligible $NO_x$ production associated with oxidation of $N_2$ from the combustion air. Production of $NO_x$ is undesirable because it reacts with volatile organic chemicals and sunlight to form ozone.

The two most common types of FCC regenerators in use today are a combustor style regenerator and a bubbling bed regenerator. Bubbling bed and combustor style regenerators may utilize a CO combustion promoter comprising platinum for accelerating the combustion of coke and CO to $CO_2$. The CO promoter decreases CO emissions but increases $NO_x$ emissions in the regenerator flue gas.

The combustor style regenerator has a lower vessel called a combustor that burns the nearly all the coke to $CO_2$ with little or no CO promoter and with low excess oxygen. The combustor is a highly backmixed fast fluidized bed. A portion of the hot regenerated catalyst from the upper regenerator is recirculated to the lower combustor to heat the incoming spent catalyst and to control the combustor density and temperature for optimum coke combustion rate. As the catalyst flue gas mixture enters the combustor riser, the velocity is further increased and the two-phase mixture exits through symmetrical downturned disengager arms into upper regenerator. The upper regenerator separates the catalyst from the flue gas with the disengager the followed by cyclones and return it to the catalyst bed which supplies hot regenerated catalyst to both the riser reactor and lower combustor.

A bubbling bed regenerator carries out the coke combustion in a dense fluidized bed of catalyst. Fluidizing combustion gas forms bubbles that ascend through a discernible top surface of a dense catalyst bed. Only catalyst entrained in the gas exits the reactor with the vapor. Cyclones above the dense bed to separate the catalyst entrained in the gas and return it to the catalyst bed. The superficial velocity of the fluidizing combustion air is typically less than 1.2 m/s (4 ft/s) and the density of the dense bed is typically greater than 480 kg/m$^3$ (30 lb/ft$^3$) depending on the characteristics of the catalyst. The mixture of catalyst and vapor is heterogeneous with pervasive vapor bypassing of catalyst. The temperature will increase in a typical bubbling bed regenerator by about 17° C. (about 30° F.) or more from the dense bed to the cyclone outlet due to combustion of CO in the dilute phase. The flue gas leaving the bed may have about 2 mol-% CO. This CO may require about 1 mol-% oxygen for combustion. Assuming the flue gas has 2 mol-% excess oxygen, there will likely be 3 mol-% oxygen at the surface of the bed and higher amounts below the surface. Excess oxygen is not desirable for low $NO_x$ operation.

A regeneration process to burn off essentially all of the coke on the catalyst is called a "full burn" and requires excess oxygen, typically at amounts between about 0.5 and 4 mol-%. There is a need for an FCC process that lowers $NO_x$ emissions while ensuring the catalyst is regenerated to be essentially free of coke.

SUMMARY OF THE INVENTION

An FCC process producing lower $NO_x$ emissions during regeneration by using excess oxygen levels at less than or equal to about 0.5 mol-% and a plenum temperature above about 730° C. (about 1350° F.). The process may further include limiting the Pt content in the catalyst to less than or equal to about 0.5 ppm. $NO_x$ emissions produced through this process may be below 20 ppmv. The process may also include adjusting the metal content of the feedstock for such metals as antimony (Sb), nickel (Ni), or vanadium (V). Additional variables for reducing $NO_x$ emissions that may be used in conjunction with this process may include increasing the flue gas residence time, injecting $NH_3$ into the flue gas, adding or using $NO_x$-reducing catalysts, increasing stripping of the catalyst, and increasing the catalyst zeolite to matrix ratio.

DETAILED DESCRIPTION

This invention relates generally to an improved FCC process. Specifically, this invention may relate to an FCC process with lower $NO_x$ emissions. $NO_x$ reacts with other chemicals in the air to produce hazardous materials for the environment.

Figure 1:
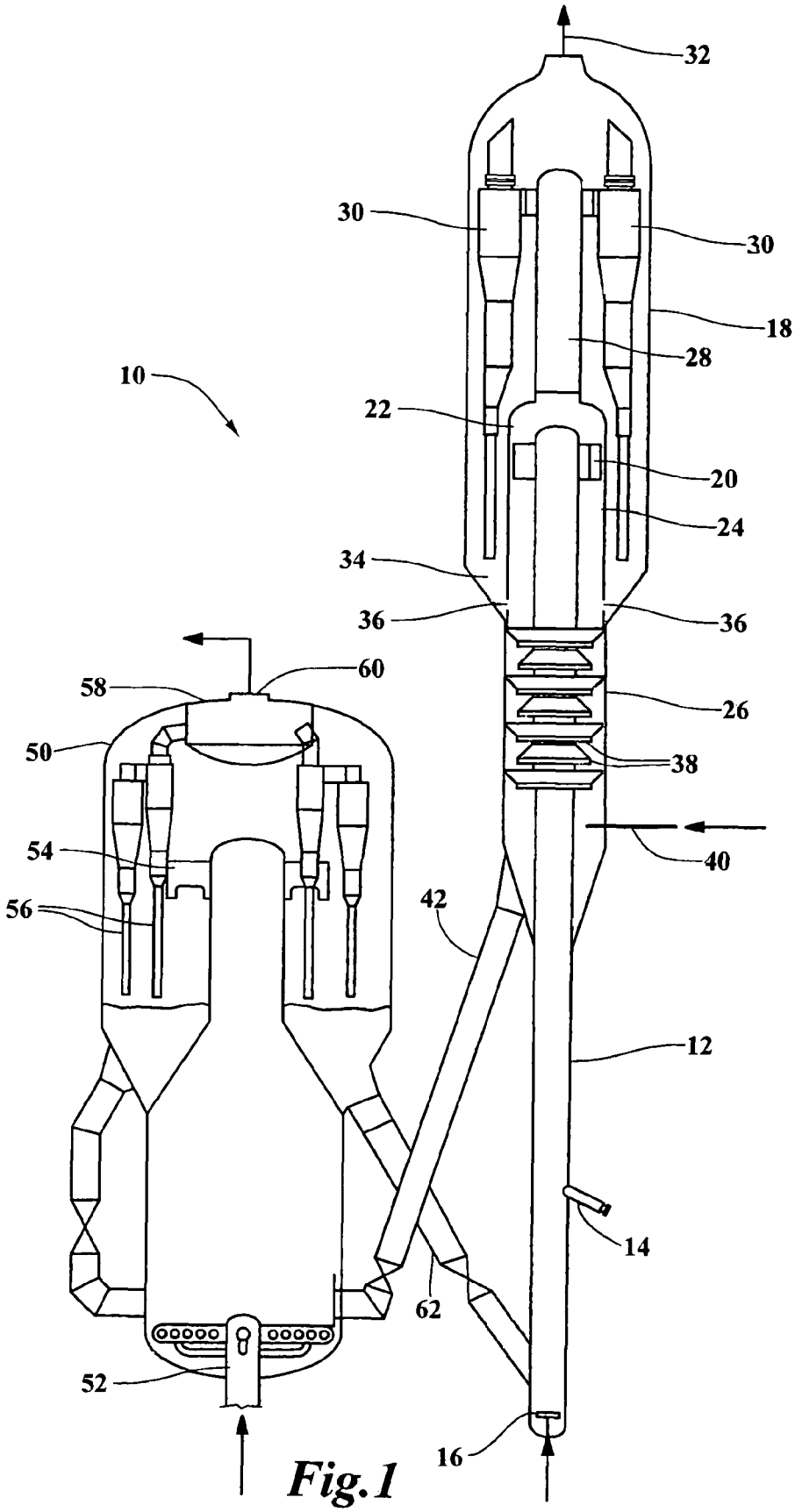
FIG. 1 is an elevational diagram showing an FCC unit.

The FCC process may use an FCC unit 10, as shown in FIG. 1. Feedstock enters a riser 12 through a feed distributor 14. Feedstock may be mixed with steam in the feed distributor 14 before exiting. Lift gases, which may include inert gases or steam, enters through a steam distributor 16 in the lower portion of the riser and creates a fluidized medium with the catalyst. Feedstock contacts the catalyst to produce cracked hydrocarbon products and spent catalyst. The hydrocarbon products are separated from the spent catalyst in the reactor vessel 18.

In the reactor vessel 18, the blended catalyst and reacted feed vapors enter through a riser outlet 20 and separated into a cracked product vapor stream and a collection of catalyst particles covered with substantial quantities of coke and generally referred to as spent catalyst or "coked catalyst." Various arrangements of separators to quickly separate coked catalyst from the product stream may be utilized. In particular, a swirl arm arrangement 22, provided at the end of the riser 12, may further enhance initial catalyst and cracked hydrocarbon separation by imparting a tangential velocity to the exiting catalyst and cracked product vapor stream mixture. The swirl arm arrangement 22 is located in an upper portion of a separation chamber 24, and a stripping zone 26 is situated in the lower portion. Catalyst separated by the swirl arm arrangement 22 drops down into the stripping zone 26.

The cracked product comprising cracked hydrocarbons including gasoline and light olefins and some catalyst may exit the separation chamber 24 via a gas conduit 28 in communication with cyclones 30. The cyclones 30 may remove remaining catalyst particles from the product vapor stream to reduce particle concentrations to very low levels. The product vapor stream may exit the top of the reactor vessel 18 through a product outlet 32. Catalyst separated by the cyclones 30 returns to the reactor vessel 18 through diplegs into a dense bed 34 where catalyst will pass through chamber openings 36 and enter the stripping zone 26. The stripping zone 26 removes adsorbed hydrocarbons from the surface of the catalyst by counter-current contact with steam over the optional baffles 38. Steam may enter the stripping zone 26 through a line 40. A spent catalyst conduit 42 transfers spent catalyst to a regenerator 50.

As shown in FIG. 1, the regenerator 50 receives the spent catalyst and typically combusts the coke from the surface of the catalyst particles by contact with an oxygen-containing gas. The oxygen-containing gas enters the bottom of the regenerator 50 via a regenerator distributor 52 and passes through a dense fluidizing bed of catalyst. Flue gas consisting primarily of $N_2$, $H_2O$, $O_2$, $CO_2$ and perhaps containing $NO_x$ and CO passes upwardly from the dense bed into a dilute phase of the regenerator 50. A primary separator, such as a tee disengager 54, initially separates catalyst from flue gas. Regenerator cyclones 56, or other means, remove entrained catalyst particles from the rising flue gas. Flue gas enters a plenum 58 before exiting the vessel through a plenum outlet 60. Combustion of coke from the spent catalyst particles raises the temperatures of the catalyst. The catalyst may pass, regulated by a control valve, through a regenerator standpipe 62 which attaches to the bottom portion of riser 12.

At FCC regenerator operating conditions, studies indicate there is negligible $NO_x$ production associated with oxidation of $N_2$ from the combustion air. Rather, most of the $NO_x$ produced results from the combustion of the coke on the spent catalyst during the regeneration part of the FCC process.

Most $NO_x$ appears to be formed in the initial stages of spent catalyst regeneration from organic nitrogen compounds cracked or desorbed from the spent catalyst upon heating to regenerator temperature. Sampling the combustion gases at increasing elevations in a combustor style regenerator also indicates that $NO_x$ are at their maximum during the early portion of regeneration by showing $NO_x$ concentrations are greater in the lower and middle part of the regenerator, early in the regeneration process, than at the upper portion of the regenerator. Laboratory experiments show that preheating spent catalyst to regenerator temperature with the inert gas helium before adding helium with oxygen mixture produces less $NO_x$, indicating that preheating without oxygen present drives off volatile, organic nitrogen compounds that are readily oxidized to $NO_x$. Also pilot plant experiments show that increasing the temperature of spent catalyst stripper to drive off volatile organics reduces $NO_x$ emissions.

Many variables affect the production of $NO_x$. The addition of platinum-based CO combustion promoters increases $NO_x$ emissions and may be one of the most important variables in driving $NO_x$ production. For example, pilot plant data indicates that 1 ppm of fresh platinum in the inventory can increase $NO_x$ production by five-fold, and 2-4 ppm fresh platinum can increase $NO_x$ production by ten-fold. The impact of added fresh platinum seemed to level off after the 2 ppm amount.

Platinum, which is known to catalyse oxidation of $NH_3$ to oxides of nitrogen, may be oxidizing volatile nitrogen compounds, such as $NH_3$, HCN and larger organic nitrogen compounds, to $NO_x$ in high yield with low yields of elemental $N_2$. Platinum may also decrease CO, afterburn, and temperature of the regenerator dilute phase, all three of which correlate with decreased $NO_x$ production.

Another variable, in addition to platinum, in $NO_x$ production is excess oxygen. Increased excess oxygen in the regenerator, has been shown to result in increased $NO_x$ production. In a combustor regenerator typically about 98% of the total combustion air is fed to the combustor and only about 2% of the air is fed to the regenerator to maintain fluidization. The 2% air fed to the regenerator corresponds to about 0.4% excess oxygen in flue gas if none of it was consumed. Therefore, when a combustor style regenerator is operated at flue gas-excess oxygen levels below 0.5%, the combustion gases leaving the combustor are enriched in CO, HCN, and other $NO_x$-reducing species and low in oxygen. These species are then burned at low oxygen concentrations in the upper regenerator resulting in very low $NO_x$ emissions.

An additional variable is the regenerator plenum 58, or flue gas, temperature. When operating at low platinum levels and low excess oxygen levels, temperatures increase for the regenerator dilute phase, regenerator cyclones 56, plenum 58, and flue gas. Historically this has been considered undesirable for cyclone life and refiners often increase excess oxygen or increase platinum promoter additions, or both, to cool the regenerator cyclones 56. Therefore, it was unexpected to learn in the development of this process that NOx may decrease strongly with increasing regenerator dilute phase and plenum temperatures. This is counter-intuitive because "thermal" NO (NO produced by oxidation of $N_2$ by $O_2$) increases with combustion temperature. High combustion temperatures are known to make very high levels of thermal $NO_x$ in CO boilers and conventional furnaces. Here, however, $NO_x$ production may decrease with increased plenum 58 or flue gas temperature. In this situation, $NO_x$ may decrease by about 1% per about 0.5° C. (1° F.). In general, $NO_x$ at 0% excess oxygen decreased from 40 ppmv at about 675° C. (1250° F.) to about 20 ppmv at about 730° C. (1350° F.). This finding appears to be opposite to conventional wisdom for FCC processing.

The role of the transition metals nickel, vanadium and iron present in FCC feedstocks on $NO_x$ formation appears to be complex. In an oxidizing environment, feed nickel and vanadium deposited on the catalyst increase $NO_x$ formation. In pilot plant testing, increasing catalyst vanadium from 930 to 1540 ppm by adding organic vanadium compound to the feedstock increased $NO_x$ emissions from 20 ppmv to about 35 ppmv at 1.5 mol-% excess oxygen. Similarly, increased $NO_x$ levels occur with higher nickel content feedstock. For example, in pilot plant experiments a high nickel content catalyst at 8400 ppm, produced 55 ppmv $NO_x$ at 1.5 mol-% excess oxygen. However, also in an oxidizing environment, nickel and vanadium may reduce high levels of NO.

For example, when 0.09 to 0.11 gm/hr of NO was added to the air feed to a pilot plant regenerator containing platinum at conditions that produced about 0.11 gm/hr of NO, only about 60 to 70% of the added NO reported to the flue gas for an effective conversion of 30-40% of the added NO. With no platinum present, all of the additional NO was reduced. From these data, it appears metals on FCC catalyst may reduce high levels of NO in oxidizing conditions (1% excess oxygen) or that NO formation from organic nitrogen compounds by these metals is suppressed by high NO levels.

In a reducing environment, as shown in laboratory testing, (helium+CO or helium+Coke on catalyst), nickel, vanadium, and iron on FCC catalyst can reduce NO with CO or Carbon, so it appears that these feed metals catalyze may either formation or reduction of $NO_x$ depending upon the local concentrations of oxygen, $NO_x$ reductants, and NO. Commercially, reducing, weakly oxidizing and highly oxidizing environments all probably exist because the large diameters may cause mixing non-uniformities. Nickel, vanadium, and iron may, on balance, catalyze net $NO_x$ reduction in low oxygen areas of the regenerator.

For many years antimony has been injected into the FCC feed to suppress $H_2$ and coke formation catalyzed by feed nickel deposited on the catalyst. Antimony has been thought to form a mixed Ni/Sb oxide with lower dehydrogenation activity. It is generally accepted that the maximum suppression of $H_2$ occurs when Sb is injected at 0.5 times the feed nickel content and excess Sb provides little or no further benefit. Furthermore, excess antimony may increase $NO_x$ emissions. Frequently, when refiners begin to inject feedstock with greater nickel content, they sometimes "base load" by injecting antimony in excess of the optimal 0.5 Sb/Ni ratio. The excess antimony can result in a 2 to 5-fold increase in $NO_x$ emissions when the injected antimony ratio to nickel content of feed is about 2.0 and the ratio of Sb/Ni on catalyst was under 0.1.

Flue gas residence time increases the reduction in NO with increasing gas contact time with the catalyst. The NO decreases about 10% per second of residence time in the combustor or about 4% per second in the regenerator 50. This is also consistent with early formation by $NO_x$ followed by its subsequent reduction in a weakly oxidizing environment.

Additional variables for reducing $NO_x$ emissions that may be used in conjunction with this process may include increasing the flue gas residence time, injecting $NH_3$ into the flue gas, adding or using $NO_x$-reducing catalysts, increasing stripping of the catalyst, and increasing the catalyst zeolite to matrix ratio. Commercial data shows reductions in NO with increasing gas contact time with the catalyst. The NO decreases about 10% per second of residence time in the combustor or about 4% per second in the larger regenerator vessel. $NH_3$ injection into the flue gas decreases $NO_x$ 1% per 1 ppm of $NH_3$ injection, consistent with 20%-40% conversion of $NH_3$ by reaction with $NO_x$, assuming a 1:1 stoichiometry. Multiple vendors sell $NO_x$-reducing catalysts that have been shown to decrease $NO_x$ emissions. Increasing the steam during the stripping step may remove greater amounts of nitrogen-containing hydrocarbon which then will not enter the regenerator for combustion. Increasing the zeolite to matrix ratio of the cracking catalyst may also decrease $NO_x$ emissions.

In summary, an FCC process to produce lower $NO_x$ emissions may include regenerating spent catalyst with an excess oxygen level less than or equal to about 0.5 mol-%, preferably less than or equal to about 0.2 mol-%, and a plenum temperature above about 730° C. (1350° F.), preferably about 750° C. (1375° F.). Furthermore, the process may include limiting the platinum in the catalyst to about 0.5 ppm or less, preferably 0.2 ppm or less. $NO_x$ emissions from this FCC process may be less than or equal to about 25 ppmv $NO_x$, preferably less than or equal to about 20 ppmv $NO_x$. Modifications to this process to lower $NO_x$ emissions may include selecting a feedstock having an antimony content less than about 0.5 times, preferably about 0.2 times, its nickel content. CO combustion promoters may be used, preferably substantially free of platinum, and further a $NO_x$-reducing catalyst may be used. The regenerating step of the process may use a combustion regenerator or a bubbling bed regenerator. Ammonia may also be injected into the flue gas, preferably at an amount approximately equal to or in excess of the amount of $NO_x$ in the flue gas, before exiting the regenerator.

EXAMPLE 1

Figure 2:
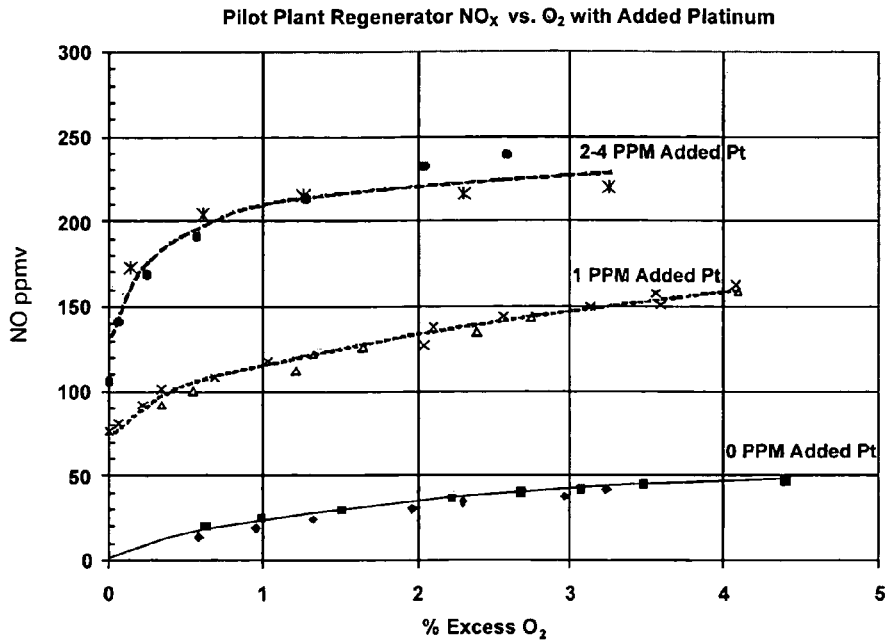
FIG. 2 is a graph showing $NO_x$ increasing with the addition of platinum.

As shown in FIG. 2, NO emissions increase as platinum containing promoters are added. This example shows an FCC pilot plant regenerator versus flue gas Oxygen concentration at three levels of platinum in catalyst. The oxygen source was air used for catalyst regeneration and the platinum source was a commercial CO combustion promoter with approximately 850 ppm Pt. The data show a strong interaction between $O_2$ concentration (measured on a dry basis in the flue gas) and added platinum on NO emissions. The addition of even 1 ppm of Pt increases $NO_x$ at least 5-fold at 0.5% vol % $O_2$.

EXAMPLE 2

Figure 3:
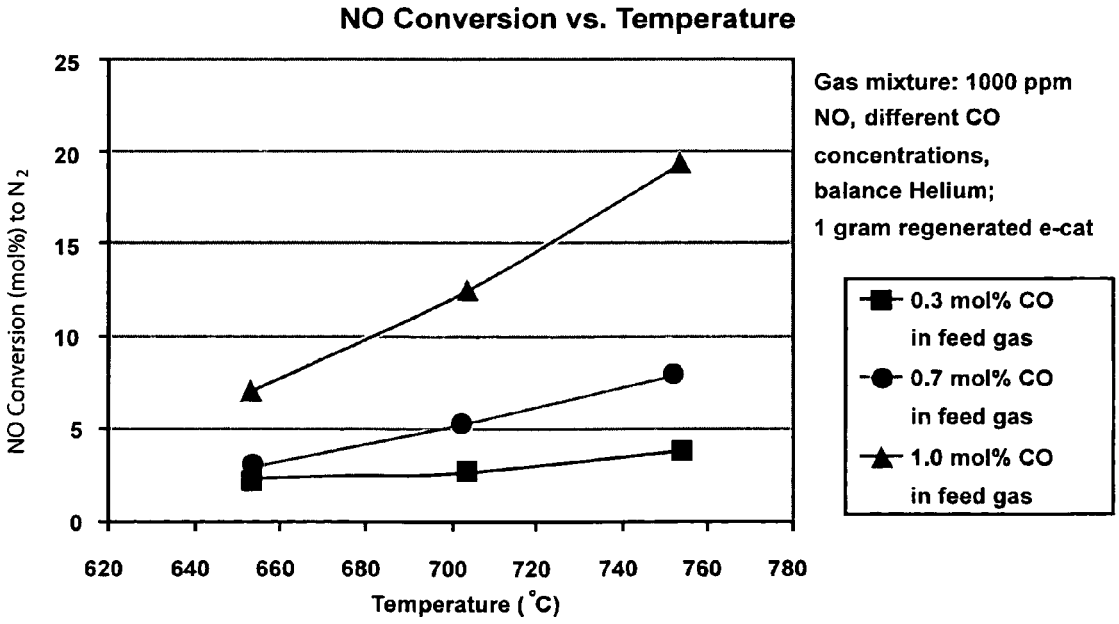
FIG. 3 is a graph showing NO conversion to $N_2$ increasing with increased temperature.

As shown in FIG. 3, NO conversion to $N_2$ increases with increased flue gas temperature. This example shows the extent of conversion of NO by excess CO in Helium over a regenerated (<0.01 wt % carbon) commercial equilibrium catalyst. The data show the interaction of CO concentration and regenerator temperature on the rate of NO reduction. This commercially important reaction requires temperatures in excess of 700° C. and preferably in excess of 730° C. and CO concentrations greater than 1000 ppm entering the dilute phase to provide substantial $NO_x$ reductions.

Preferred embodiments of this invention are described herein, including the best mode known to the inventors for carrying out the invention. It should he understood that the illustrated embodiments are exemplary only, and should not be taken as limiting the scope of the invention.

What is claimed is:

1. A fluid catalytic cracking process with lower $NO_x$ emissions, comprising the steps of:

contacting a hydrocarbon feedstock with a catalyst in a riser to produce a mixture of cracked products and spent catalyst;

separating said cracked products from said spent catalyst;

stripping said spent catalyst;

regenerating said spent catalyst in a regenerator free of CO combustion promoter with an excess oxygen level less than or equal to about 0.5 mol-% and a flue gas temperature above about 730° C.;

separating regenerated catalyst from flue gas, said flue gas containing less than or equal to about 25 ppmv $NO_x$; and recycling said regenerated catalyst into said riser.

2. The fluid catalytic cracking process of claim 1, wherein said oxygen in said regenerating step has an excess oxygen level of equal to or less than about 0.2 mol-%.

3. The fluid catalytic cracking process of claim 1, wherein said feedstock is selected having an antimony content less than 0.5 times its nickel content.

4. The fluid catalytic cracking process of claim 1, wherein said feedstock is selected having an antimony content less than 0.2 times its nickel content.

5. The fluid catalytic cracking process of claim 1, wherein said regenerator is a combustor regenerator.

6. The fluid catalytic cracking process of claim 1, wherein said regenerator is a bubbling bed regenerator.

7. The fluid catalytic cracking process of claim 1, wherein said catalyst comprises a $NO_x$-reducing catalyst.

8. The fluid catalytic cracking process of claim 1, further comprising the step of injecting ammonia into said flue gas.

9. The fluid catalytic cracking process of claim 8, wherein said ammonia is injected at an amount greater than or equal to the amount of $NO_x$ in said flue gas.

10. The fluid catalytic cracking process of claim 1, wherein said stripping step further comprises introducing steam in an amount sufficient to reduce the hydrogen content in the coke on said spent catalyst.

11. The fluid catalytic cracking process of claim 1, further comprising the step of adding fresh catalyst to said regenerated catalyst.

12. A method of reducing $NO_x$ emissions from a regeneration zone during fluid catalytic cracking of a hydrocarbon feedstock, comprising:

regenerating spent catalyst in a regenerator free of CO combustion promoter with an excess oxygen level less than or equal to about 0.5 mol-% and a flue gas temperature above about 730° C.;

separating regenerated catalyst from flue gas, said flue gas containing less than or equal to about 25 ppmv $NO_x$; and recycling said regenerated catalyst free of CO combustion promoter into a riser.

13. A fluid catalytic cracking process with lower $NO_x$ emissions, comprising the steps of:

contacting a hydrocarbon feedstock with a catalyst in a riser to produce a mixture of cracked products and spent catalyst;

separating said cracked products from said spent catalyst;

stripping said spent catalyst using steam;

regenerating said spent catalyst in a regenerator free of CO combustion promoter with an excess oxygen level less than or equal to about 0.2 wt-% and a flue gas temperature above about 730° C.

separating the regenerated catalyst from flue gas;

adding ammonia into said flue gas;

discharging said flue gas having a $NO_x$ content between about 10 and about 30 ppmv; and recycling said regenerated catalyst into said riser.

* * * * *